US008601915B1

(12) United States Patent
Garvey

(10) Patent No.: US 8,601,915 B1
(45) Date of Patent: Dec. 10, 2013

(54) WRENCH STOP

(76) Inventor: Philip M. Garvey, Warwick, RI (US)

( * ) Notice: Subject to any disclaimer, the term of this patent is extended or adjusted under 35 U.S.C. 154(b) by 238 days.

(21) Appl. No.: 13/073,302

(22) Filed: Mar. 28, 2011

(51) Int. Cl.
*B25B 13/00* (2006.01)

(52) U.S. Cl.
USPC ..... 81/185.2; 81/180.1

(58) Field of Classification Search
USPC ..... 81/185.2, 186, 180.1, 125, 119, 124.3, 81/125.1
See application file for complete search history.

(56) References Cited

U.S. PATENT DOCUMENTS 2,659,258 A * 11/1953 Dillard ..... 81/125
4,058,032 A 11/1977 Jacks
4,406,188 A 9/1983 Mills
4,738,168 A 4/1988 Carminati
4,823,652 A 4/1989 Morrissey et al.
5,983,758 A 11/1999 Tanner
6,089,127 A * 7/2000 Dominguez ..... 81/119
6,732,616 B2 * 5/2004 Lin ..... 81/180.1
6,865,971 B2 * 3/2005 Ernesti ..... 81/124.3
7,228,764 B1 6/2007 Macor
7,340,983 B2 3/2008 Ling et al.
7,673,542 B2 3/2010 Ling et al.

* cited by examiner

*Primary Examiner* — Robert Scruggs
(74) *Attorney, Agent, or Firm* — Salter & Michaelson

(57) ABSTRACT

A wrench stop on a wrench having opposite ends that include respective engagement apertures for fitting with a head member to be engaged by the engagement aperture. A slide member constructed and arranged for mounting adjacent to the engagement aperture and including an end catch. The slide member has retracted and extended positions. The slide member, in the retracted position thereof, has the end catch disposed away from the engagement aperture, and in the extended position thereof, has the end catch disposed over the engagement aperture so that the wrench piece does not disengage from the head member.

8 Claims, 3 Drawing Sheets

WRENCH STOP

FIELD OF THE INVENTION

The present invention relates in general to wrenches and pertains more particularly to an improved accessory for a wrench so as to prevent the wrench from slipping off of a nut or bolt head.

BACKGROUND OF THE INVENTION

There presently exists some prior art relating to a stop used on a wrench. By way of example, refer to U.S. Pat. No. 6,865,971 to Ernesti. However, many of these stop constructions are permanent and do not provide the ability for a selective use of the stop structure. Other prior art wrench constructions that employ a stop are relatively complex in construction and are thus impractical from a commercial standpoint. Other examples are found in U.S. Pat. No. 4,738,168 to Carminati; U.S. Pat. No. 5,983,758 to Tanner; and U.S. Pat. No. 7,228,764 to Macor.

It is an object of the present invention to provide an improved wrench stop, and one that is, in particular, of simplified construction and yet effective in providing a stop or catch for preventing the wrench from slipping off of a bolt head or nut.

Another object of the present invention is to provide an improved wrench stop in which the stop member thereof is selectively movable so as to function either as a stop or having a retracted position in which the wrench can be used in its normal manner.

Still a further object of the present invention is to provide an improved wrench stop that can be used with a variety of different types of wrenches including open-end wrenches, box-type wrenches, ratchet and non-ratchet wrenches.

A further object of the present invention is to provide an improved wrench stop or retainer for preventing a wrench from disengaging from a head member that is to be turned, and in which the retainer or stop can be manufactured inexpensively, is readily adapted to existing wrench constructions, and is of simplified design.

SUMMARY OF THE INVENTION

To accomplish the foregoing and other objects, features and advantages of the present invention there is provided a wrench stop comprising: a wrench piece having opposite ends that include respective engagement apertures for fitting with a head member to be engaged by the engagement aperture and a slide member constructed and arranged for mounting adjacent to the engagement aperture and including an end catch. The slide member has retracted and extended positions. The slide member, in the retracted position thereof, has the end catch disposed away from the engagement aperture, and in the extended position thereof, has the end catch disposed over the engagement aperture so that the wrench piece does not disengage from the head member.

In accordance with other aspects of the present invention the slide member comprises an elongated slide piece; including a retaining block fixed to the wrench piece adjacent to the engagement aperture and having a passage for slidably receiving the elongated slide piece; including a first stop fixed to the wrench piece for contact with the elongated slide piece to limit the retracted position of the slide piece; including a second stop formed at an end of the elongated slide piece opposite to the end catch to limit the extended position of the slide piece; the engagement aperture may be formed by an open end or by a box end; the wrench piece may be a ratchet type with ratchet teeth disposed within the engagement aperture; including a pair of slide members each including an elongated slide piece; the wrench piece has an aperture free shaft disposed between the respective engagement apertures with the respective slide members mounted along the aperture free shaft; including a pair of retaining blocks fixed to but disposed adjacent to the engagement aperture and each having a passage for slidably receiving a respective elongated slide piece; including a pair of first stops each fixed to the shaft for contact with a respective elongated slide piece to limit the retracted position of the slide piece; including a pair of second stops each formed at an end of the elongated slide piece opposite to the end catch to limit the extended position of the slide piece; and wherein the slide pieces move away from each other in the extended position and move toward each other in the retracted position.

In accordance with another embodiment of the present invention there is provided a retainer for preventing a wrench from disengaging from a head member that is to be turned. The retainer comprises a slide member constructed and arranged for mounting adjacent to an engagement aperture of the wrench and including an end catch. The slide member has retracted and extended positions. The slide member, in the retracted position thereof, has the end catch disposed away from the engagement aperture, and in the extended position thereof, has the end catch disposed over the engagement aperture so that the wrench does not disengage from the head member.

In accordance with still other aspects of the present invention the slide member comprises an elongated slide piece, the wrench includes a wrench piece and further including a retaining block fixed to the wrench piece adjacent to the engagement aperture and having a passage for slidably receiving the elongated slide piece; including a first stop fixed to the wrench piece for contact with the elongated slide piece to limit the retracted position of the slide piece; including a second stop formed at an end of the elongated slide piece opposite to the end catch to limit the extended position of the slide piece; including a pair of retaining blocks fixed to but disposed adjacent to the engagement aperture and each having a passage for slidably receiving a respective elongated slide piece; a pair of first stops each fixed to the shaft for contact with a respective elongated slide piece to limit the retracted position of the slide piece; and a pair of second stops each formed at an end of the elongated slide piece opposite to the end catch to limit the extended position of the slide piece; and wherein the slide pieces move away from each other in the extended position and move toward each other in the retracted position.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to the wrench stop that is embodied in the illustrations of FIGS. 1-5. For the purpose of illustration herein, there is shown a two-ended ratchet wrench 10. It is understood that, although from an illustrative standpoint, there is disclosed a ratchet wrench, the principles of the present invention can be applied to other types of wrenches including standard open-end and box-type wrenches. Also, in the illustration herein the ratchet wrench has different size ratchet members at each end. The principles of the present invention also apply to a wrench wherein there is an engagement aperture at only one end thereof.

Figure 1:
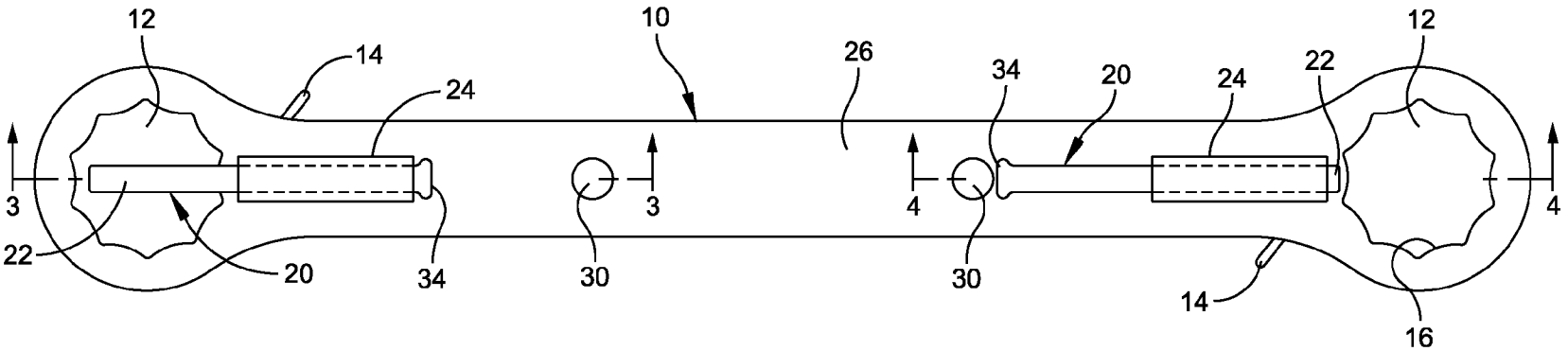
FIG. 1 is a plan view of a wrench construction in accordance with the present invention having the wrench stop.
Figure 3:
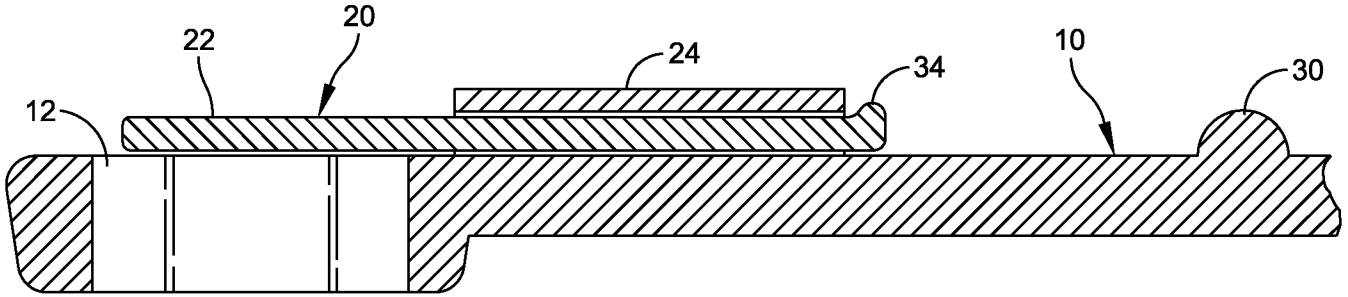
FIG. 3 is a cross-sectional view taken along line 3-3 of FIG. 1.

In the drawings herein, the wrench 10 is considered as having opposite end engagement apertures 12. Also illustrated in FIG. 1 is the directional lever 14 that is conventionally associated with a ratchet wrench and that can be used to ratchet the teeth in either direction. The illustration shows the ratchet teeth in the engagement aperture at 16. Because a ratchet wrench is a conventional device, further details are not provided herein as to the ratcheting mechanism. The fragmentary enlarged view of FIG. 3 illustrates the wrench engaging with a bolt 18. In the position illustrated in FIG. 3, the slide member is in its extended position preventing the wrench from falling from the bolt head 18.

Figure 2:
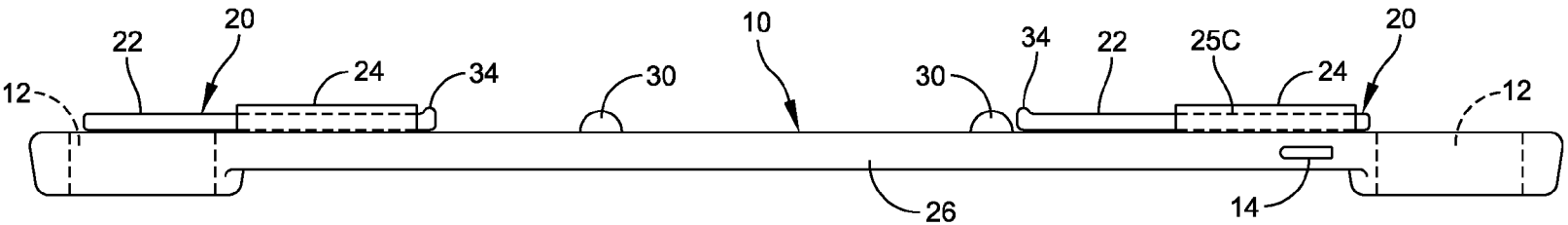
FIG. 2 is a side elevation view of the wrench of FIG. 1.

The drawings also illustrate the slide member 20. The slide member 20 is constructed and arranged for mounting adjacent to the engagement aperture 12 and each of the slide members 20 illustrated in the drawings includes an end catch 22. The slide member 20, is considered as having opposite retracted and extended positions. The slide member, in the retracted position thereof, has the end catch 22 disposed away from the engagement aperture. The slide member, in the extended position thereof, has the end catch 22 disposed over the engagement aperture 12 so that the wrench does not disengage from the bolt head or nut. In FIGS. 1 and 2 for the left hand end of the wrench, the slide member is in its extended position. In FIGS. 1 and 2 for the right hand end of the wrench, the slide member 20 is shown in its retracted position.

For support of the slide member, there are a pair of retaining blocks 24. Each of the retaining blocks 24 is fixed to the wrench adjacent to the engagement aperture 12 and having a passage 25 for slidably receiving the elongated slide piece 20. FIG. 2 shows a partial cut away at the right hand retaining block 24 to illustrate the channel 25.

In addition to the opposite aperture ends of the wrench, the wrench is also provided with an aperture-free interconnecting shaft 26 that is integrally formed with the ratchet apertures at opposite ends of the wrench. As illustrated in, for example, FIGS. 1 and 2, at the shaft 26 there are disposed a pair of stops 30. Each of these stops is disposed in line with the elongated slide member but spaced from the associated retaining block 24. In FIGS. 1 and 2 the right hand stop 30 is shown engaged by the slide member 20 so as to limit the retracted position of the slide member. In FIGS. 1 and 2 at the left hand side of the wrench, the slide member 20 is shown spaced away from the stop 30. Each of the stops 30 may be in the form of a small projection that is integrally formed with the shaft 26. Refer also to the cross-sectional views of FIGS. 3 and 4.

The slide member 20 is also provided with a stop ledge 34. The ledge 34 is disclosed as a small upward projection from an end of the slide member 20 opposite to the end catch 22. The stop ledge 34 limits the extended position of the slide member 20. This is illustrated to the left in FIGS. 1 and 2 wherein the stop ledge 34 engages the retaining block 24 so as to prevent the slide member 20 from moving any further to the left.

Figure 4:
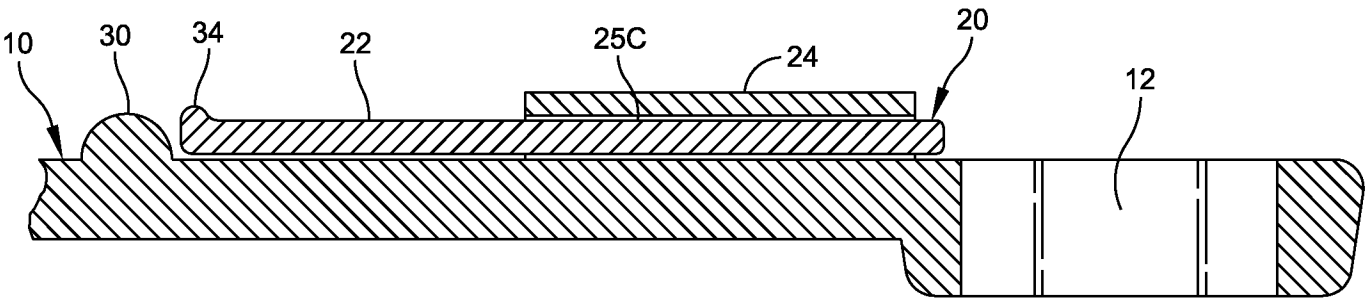
FIG. 4 is a cross-sectional view taken along line 4-4 of FIG. 1.
Figure 5:
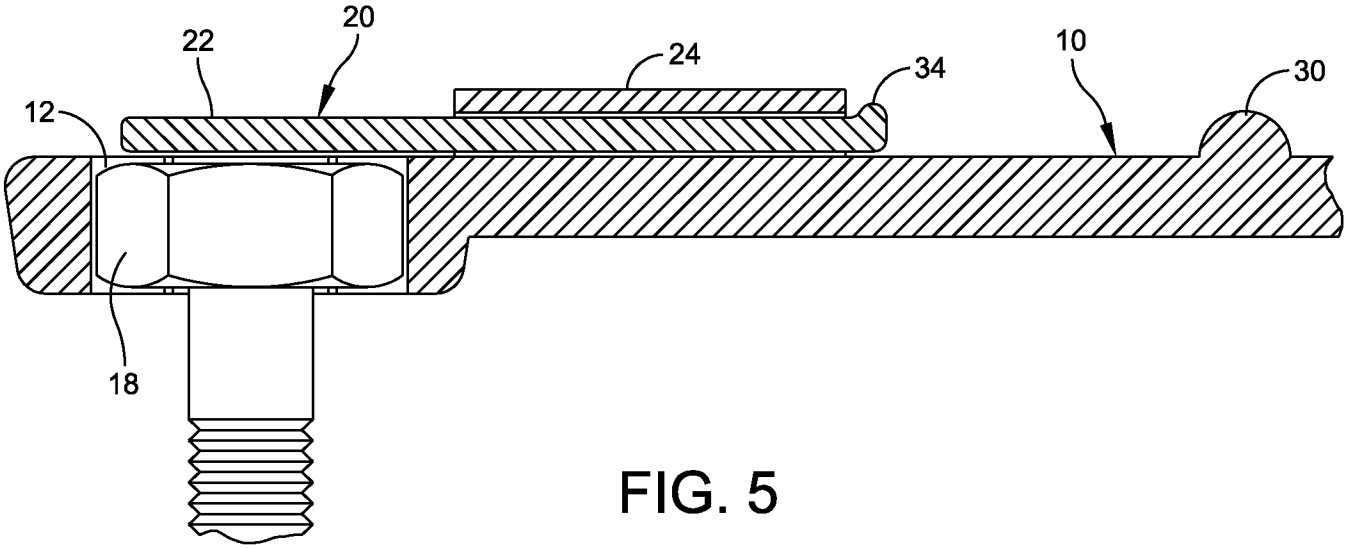
FIG. 5 is a fragmentary cross-sectional view similar to that illustrated in FIG. 3 but showing the use of the slide member over a bolt head.

FIG. 5 illustrates the manner in which the end catch 22 of the slide member 20 engages over the engagement aperture 12 of the wrench. The slide member 20 is shown moved to its extended position so that the end catch 22 is disposed over the bolt head 18. This prevents the wrench from moving downwardly as the wrench is used to tighten or loosen the bolt. The slide member 22 may also be moved to its retracted position as illustrated in FIG. 4. In that position the wrench can be used in its normal manner.

In accordance with different embodiments of the present invention, as indicated previously, the wrench may be a ratchet-type wrench as illustrated, or can be a non-ratchet type wrench. For example, the slide member and stop arrangement of the present invention may be employed with either an open end wrench or a box style wrench. Moreover, the principles of the present invention may apply to a wrench construction in which there is only one engagement end of the wrench. The engagement aperture that is referred to may be formed by a multi-sided aperture that is referred to may be formed by a multi-sided aperture or, in the case of an open-end wrench, may be formed by two parallel side walls. As also illustrated in the drawings, the retaining blocks 24 are preferably disposed at opposite ends of the shaft 26 with the associated stops 30 mounted inboard of each of the respective retaining blocks 24. This provides a compact arrangement and yet is effective in enabling the use of opposite end slide members for engaging over a head member in a selective manner.

The stop construction of the present invention may be formed with many different types of materials. The wrench itself is typically constructed of a steel material. The slider member 20 and the retaining block 24 may likewise be constructed of a metal material.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A wrench stop comprising:

a wrench piece having opposite ends that include respective engagement apertures for fitting with a head member to be engaged by the engagement aperture;

said wrench piece having a substantially planar upper mounting surface that is disposed between said opposite ends thereof;

a pair of separate slide members each constructed and arranged for mounting adjacent to the respective engagement aperture and each including an end catch;

said slide members being elongated, spacedly disposed along said wrench piece mounting surface and having retracted and extended positions;

said slide members, in the retracted position thereof, each having the end catch disposed away from the engagement aperture;

said slide members, in the extended position thereof, each having the end catch disposed over the engagement aperture to prevent the wrench piece from moving downwardly and disengaging from the head member;

said slide members furthermore, in the extended position thereof, each having the end catch disposed over the head member to prevent the wrench piece from moving downwardly as the wrench piece is used to tighten or loosen the head member;

a pair of retaining blocks fixed to the mounting surface of the wrench piece adjacent to the respective engagement aperture, spacedly disposed along said wrench piece mounting surface and each having an elongated passage for slidably receiving the respective elongated slide member to enable the slide member to slide between extended and retracted positions;

and a pair of first stops each fixed to the wrench piece mounting surface and spacedly disposed along said wrench piece mounting surface for contact with a respective elongated slide member to limit the retracted position of the respective slide member;

each said first stop disposed inboard of a respective retaining block.

2. The wrench stop of claim 1 including a pair of second stops each formed at an end of the elongated slide member opposite to the end catch to limit the extended position of the slide member, and wherein each second stop is formed by a stop ledge at an end of the elongated slide member opposite to the end catch.

3. The wrench stop of claim 2 wherein the stop ledge is formed as an upward projection.

4. The wrench stop of claim 1 wherein each stop ledge limits the extended position of the slide member by engagement with an end of a respective retaining block.

5. The wrench stop of claim 1 wherein the spacing between the first stops is less than the spacing between the respective retaining blocks.

6. The wrench stop of claim 1 wherein the engagement aperture is formed by an open end.

7. The wrench stop of claim 1 wherein the engagement aperture is formed by a box end.

8. The wrench stop of claim 1 wherein the wrench piece is a ratchet type with ratchet teeth disposed within the engagement aperture.

* * * * *